US008169204B2

(12) United States Patent
Jian

(10) Patent No.: US 8,169,204 B2
(45) **Date of Patent: *May 1, 2012**

(54) ACTIVE CURRENT LIMITING CIRCUIT AND POWER REGULATOR USING THE SAME

(75) Inventor: Ming-Hong Jian, Hsinchu (TW)

(73) Assignee: Holtek Semiconductor Inc., Hsinchu (TW)

( * ) Notice: Subject to any disclaimer, the term of this patent is extended or adjusted under 35 U.S.C. 154(b) by 606 days.

This patent is subject to a terminal disclaimer.

(21) Appl. No.: 12/329,212

(22) Filed: Dec. 5, 2008

(65) Prior Publication Data

US 2010/0090665 A1 Apr. 15, 2010

(30) Foreign Application Priority Data

Oct. 13, 2008 (TW) ..... 97139132 A

(51) Int. Cl.
*G05F 1/618* (2006.01)
*G05F 1/573* (2006.01)

(52) U.S. Cl. ..... 323/277; 323/274; 323/273

(58) Field of Classification Search ..... 323/277, 323/274, 273

See application file for complete search history.

(56) References Cited

U.S. PATENT DOCUMENTS

| | | | | |
|---|---|---|---|---|
| 6,522,111 | B2 * | 2/2003 | Zadeh et al. | 323/277 |
| 6,933,772 | B1 * | 8/2005 | Banerjee et al. | 327/541 |
| 7,362,080 | B2 | 4/2008 | Sohn et al. | |
| 7,671,668 | B2 * | 3/2010 | Park | 327/540 |
| 7,728,565 | B2 * | 6/2010 | Wyatt | 323/269 |
| 7,746,163 | B2 * | 6/2010 | Akita | 327/541 |
| 7,816,897 | B2 * | 10/2010 | Illegems | 323/277 |

* cited by examiner

*Primary Examiner* — Bao Q Vu

(74) *Attorney, Agent, or Firm* — WPAT., P.C.; Justin King

(57) ABSTRACT

The present invention mainly relates to a current limiting circuit, also known as over-current protection circuit, and a power regulator using the same. The purpose for the circuit is to protect the power device and the loading circuit for the power regulator. The conventional current limiting circuit takes advantage of a resistor and a MOS to convert the detected over current into a voltage and then turn on a P-typed MOS to clamp the gate voltage of a power transistor so as to achieve the goal of current limiting. However, the process variation for the resistor and said MOS and their temperature variation lead to a significant error to the limiting current. The present invention, therefore, takes advantage of the current comparison to enhance the accuracy for the current limiting circuit.

14 Claims, 5 Drawing Sheets

ACTIVE CURRENT LIMITING CIRCUIT AND POWER REGULATOR USING THE SAME

BACKGROUND OF THE INVENTION

1. Field of the Invention

The present invention relates to a current limiting circuit and a power regulator using the same, more particularly to, an active current limiting circuit and a power regulator using the same.

2. Description of the Prior Arts

Generally speaking, in the application for DC voltage regulators (Also known as "power regulator"), there will always be some corresponding protection circuits such as over voltage protection, over temperature protection, and over current protection, and said over current protection can be realized by a current limiting circuit. In the most of occasions, the current limiting mechanism takes advantage of the detection of the current running through the power transistor, and a resistor is used to convert the detected current into the voltage, and then the voltage turns on a P-typed transistor so as to clamp the gate voltage of said power transistor by a charging current. Thus, the loading current of the DC voltage regulator can be limited so as to achieve the over current protection.

Refer to FIG. 1 and FIG. 2, which depicted the conventional approaches. The disclosures of FIG. 1 relates to the conventional current limiting circuit for U.S. Pat. No. 7,362,080. In FIG. 1, a resistor $R_{S100}$ detects the current flowing through a power MOS $M_{101}$ and converts the detected current into a voltage to control a transistor $M_{102}$. When the occasion of over current occurs, the voltage drop on $R_{S100}$ is adequate to turn on said $M_{102}$, that is; there will be a current flowing through $M_{102}$ to clamp the gate voltage (VEO) of said $M_{101}$ so as the goal of current limiting can be achieved. However, the most significant drawback for this approach is the minimum dropout voltage between the input side and output side of the voltage regulator will be enlarged.

FIG. 2 relates to an improved structure for the prior art of U.S. Pat. No. 7,362,080. In FIG. 2, a transistor $M_{P203}$ is used to detect the current flowing through a power transistor $M_{P201}$. When the occasion of over current occurs, the voltage drop on a resistor $R_{S201}$ is adequate to turn on a transistor $M_{P204}$, meanwhile, there will be a charging current to clamp the gate voltage of said $M_{P201}$, in the similar manner, to achieve the goal of current limiting. However, the error caused by said resistor $R_{S201}$ for process and temperature variation will directly affect the accuracy of the current limiting circuit.

Besides, since the conventional disclosures in both FIG. 1 and FIG. 2 relates to a resistive impedance, if desire to limit the current at a lower value, the resistor values must be enhanced and the corresponding die size will be also enlarged. To sum up, to enhance the accuracy for different processes and temperature variations and to improve the area efficiency for the chip area are both the important topics for the present invention.

Accordingly, in view of the above drawbacks, it is an imperative that an active current limiting circuit and a regulator using the same are designed so as to solve the drawbacks as the foregoing.

SUMMARY OF THE INVENTION

In view of the disadvantages of prior art, the primary object of the present invention relates to an active current limiting circuit and a power regulator using the same and the method thereof, which takes advantage of active components to form a feedback circuit so as to achieve the goal of high accuracy for low process and temperature variation.

According to one aspect of the present invention, which relates to a current limiting method for a power regulator, comprising the steps of:

(a) start;

(b) the power regulator provides a constant voltage at normal stable voltage situation and a power transistor inside the power regulator provides a current to a loading;

(c) sense an output current of said power transistor to see if its output current is excessive or short circuited, if no, go to (b), if yes, go to next step (d);

(d) activate an active over current limiting circuit; and (e) over current is removed? If no, go to (d); if yes, go to (b).

According to another aspect of the present invention, which relates to a current limiting circuit in a power regulator, comprising:

a P-typed power transistor, said transistor's source is receiving an unregulated first voltage source according a control signal and generating a regulated second voltage at its drain;

a feedback circuit, generating a feedback signal according to a voltage division with respect to said second voltage;

an operational amplifier, said amplifier's output is coupled to the gate of said power transistor, said amplifier's positive input terminal is coupled to said feedback circuit, and said amplifier's negative terminal is coupled to a reference voltage; and a protecting circuit, for being configured to limiting a first current flowing through said P-typed power transistor, and for enhancing the voltage at the gate of said power transistor when said first current exceeds a predetermined value; wherein, said protecting circuit comprises a plurality of transistors rather than a resistor.

According to still another aspect of the present invention, which relates to a current limiting circuit in a power regulator, comprising:

a P-typed power transistor, said transistor's source is coupled to a first voltage source;

a DC current mirror, comprising a pair of N-typed transistors, and said pair of transistors' gates are interconnected, and for one of the pair its gate and its drain are interconnected;

a DC current source, outputting a predetermined current with a direction to the ground and interconnect an output terminal of said DC current mirror at a first intersection;

a first P-typed transistor, said first P-typed transistor's source is coupled to said first voltage source, and said first P-typed transistor's gate is coupled to said first intersection, and said first P-typed transistor's drain is coupled to said P-typed power transistor's gate; and a second P-typed transistor, said second P-typed transistor's source is coupled to said first voltage source, and said second P-typed transistor's gate is coupled to the gate of said P-typed power transistor, and said second P-typed transistor's drain is coupled to an input terminal of said DC current mirror.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become readily understood from the detailed description given herein below and the accompanying drawings which are given by way of illustration only, and thus are not limitative of the present invention and wherein.

DESCRIPTION OF THE EXEMPLARY EMBODIMENTS

The following descriptions are of exemplary embodiments only, and are not intended to limit the scope, applicability, or configuration of the invention in any way. Rather, the following description provides a convenient illustration for implementing exemplary embodiments of the invention. Various changes to the described embodiments may be made in the function and arrangement of the elements described. For your esteemed members of reviewing committee to further understand and recognize the fulfilled functions and structural characteristics of the invention, several exemplary embodiments cooperating with detailed description are presented as the follows.

Figure 1:
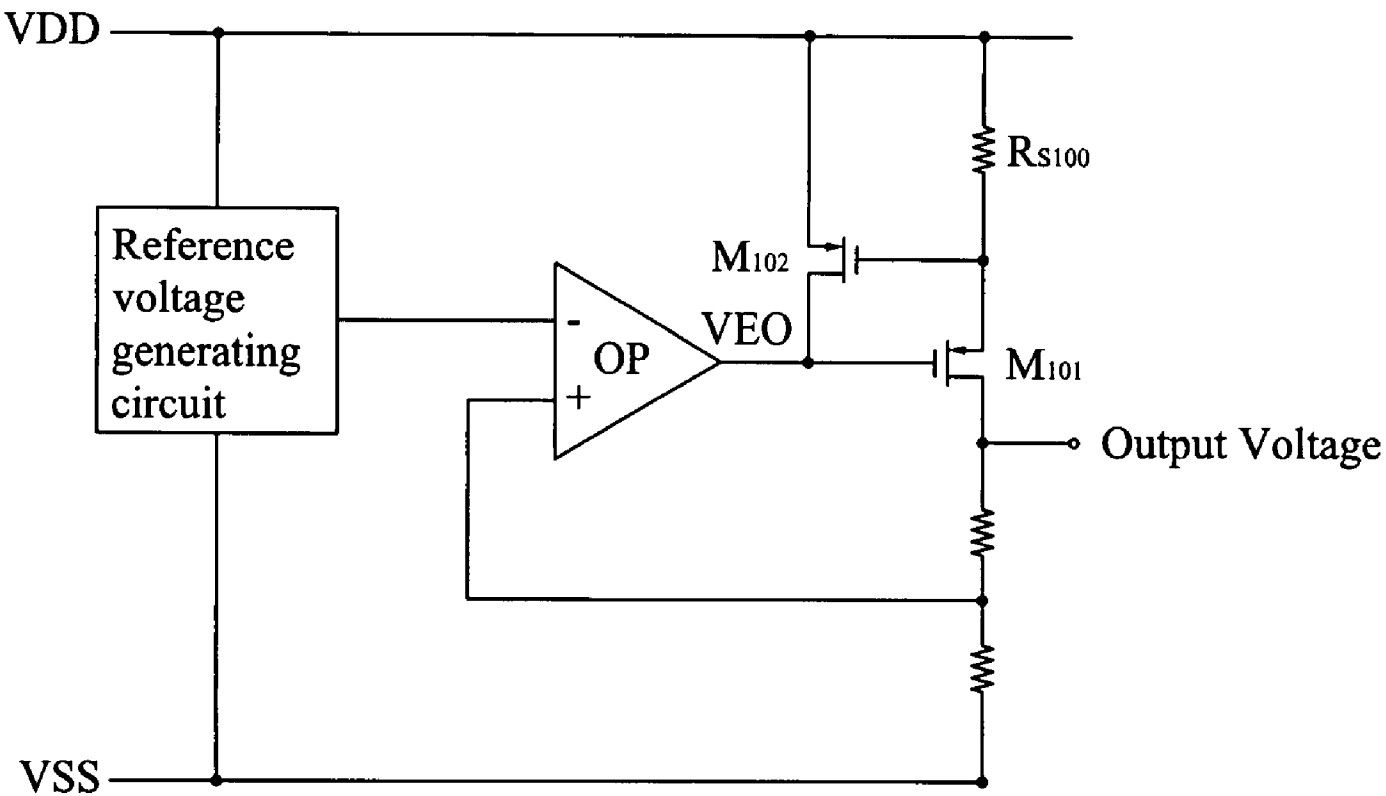
FIG.1 (Prior Art)
FIG. 1 is an exemplary schematic view of the prior art.
Figure 2:
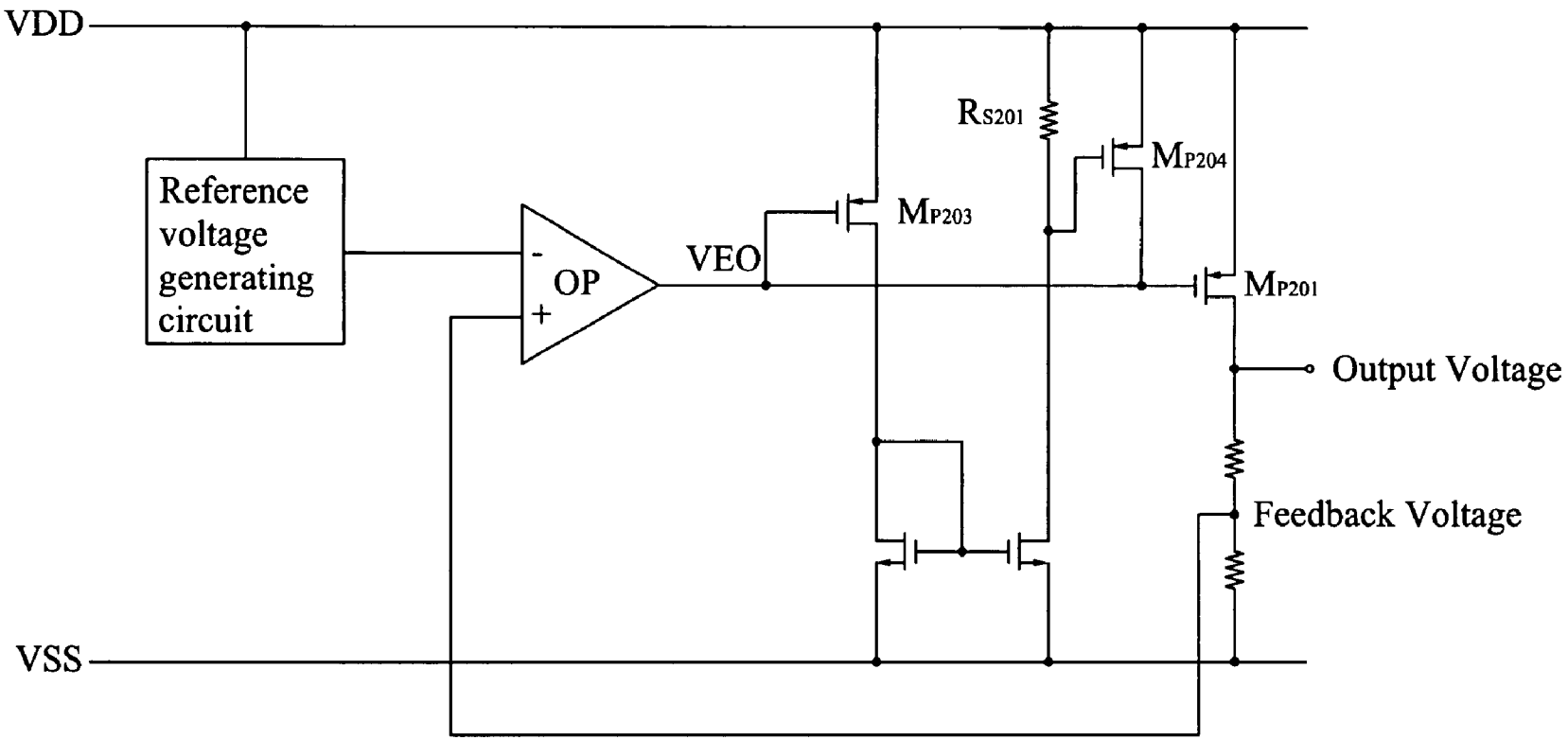
FIG.2 (Prior Art)
FIG. 2 is another exemplary schematic view of the prior art.
Figure 3:
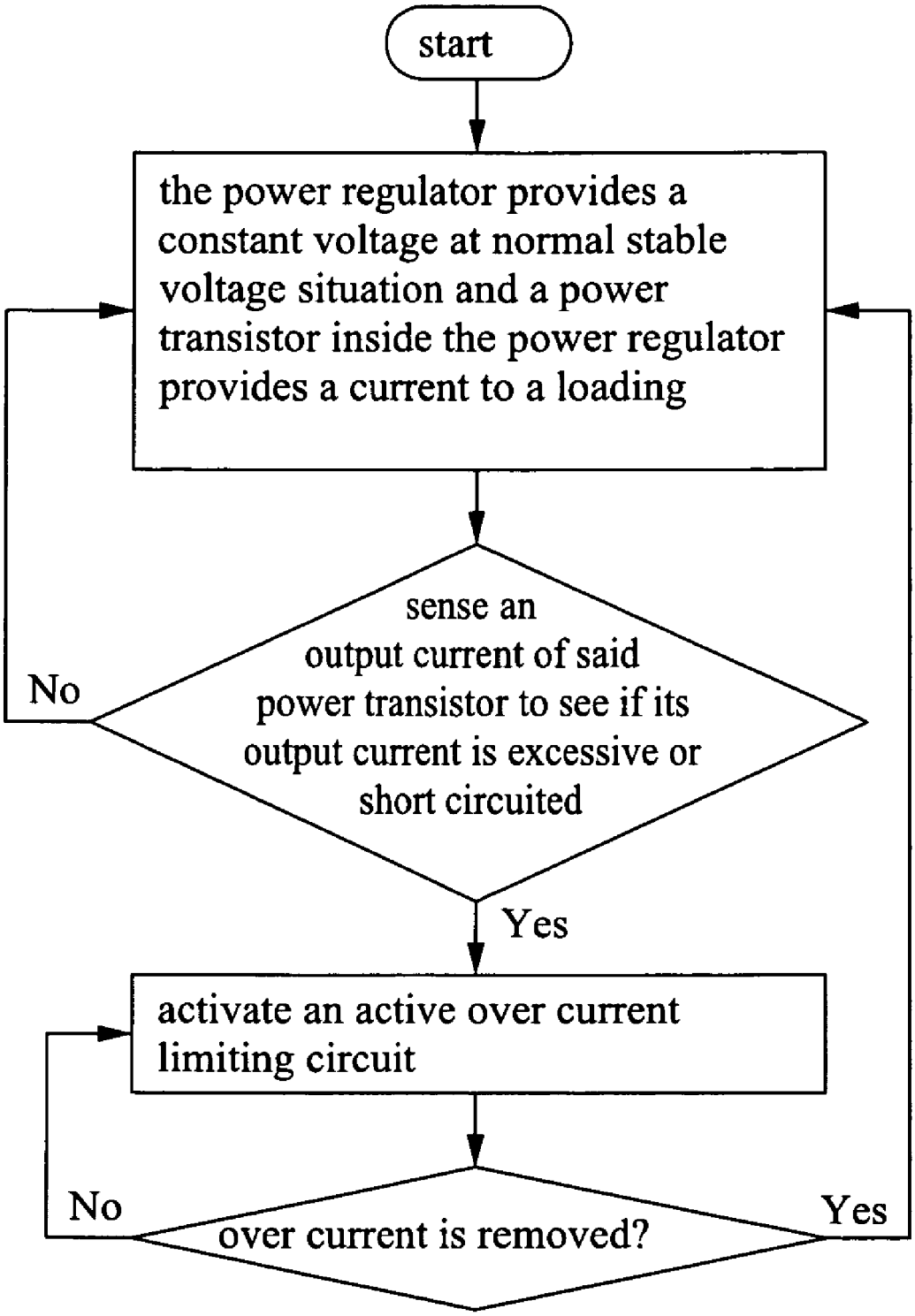
FIG. 3 is a flow chart of the method disclosed in the present invention.

Refer to FIG. 3 now, which relates to a current limiting method for a power regulator, comprising:

(a) start;

(b) the power regulator provides a constant voltage at normal stable voltage situation and a power transistor inside the power regulator provides a current to a loading;

(c) sense an output current of said power transistor to see if its output current is excessive or short circuited, if no, go to (b), if yes, go to next step (d);

(d) activate an active over current limiting circuit; and (e) over current is removed? If no, go to (d); if yes, go to (b).

Figure 4:
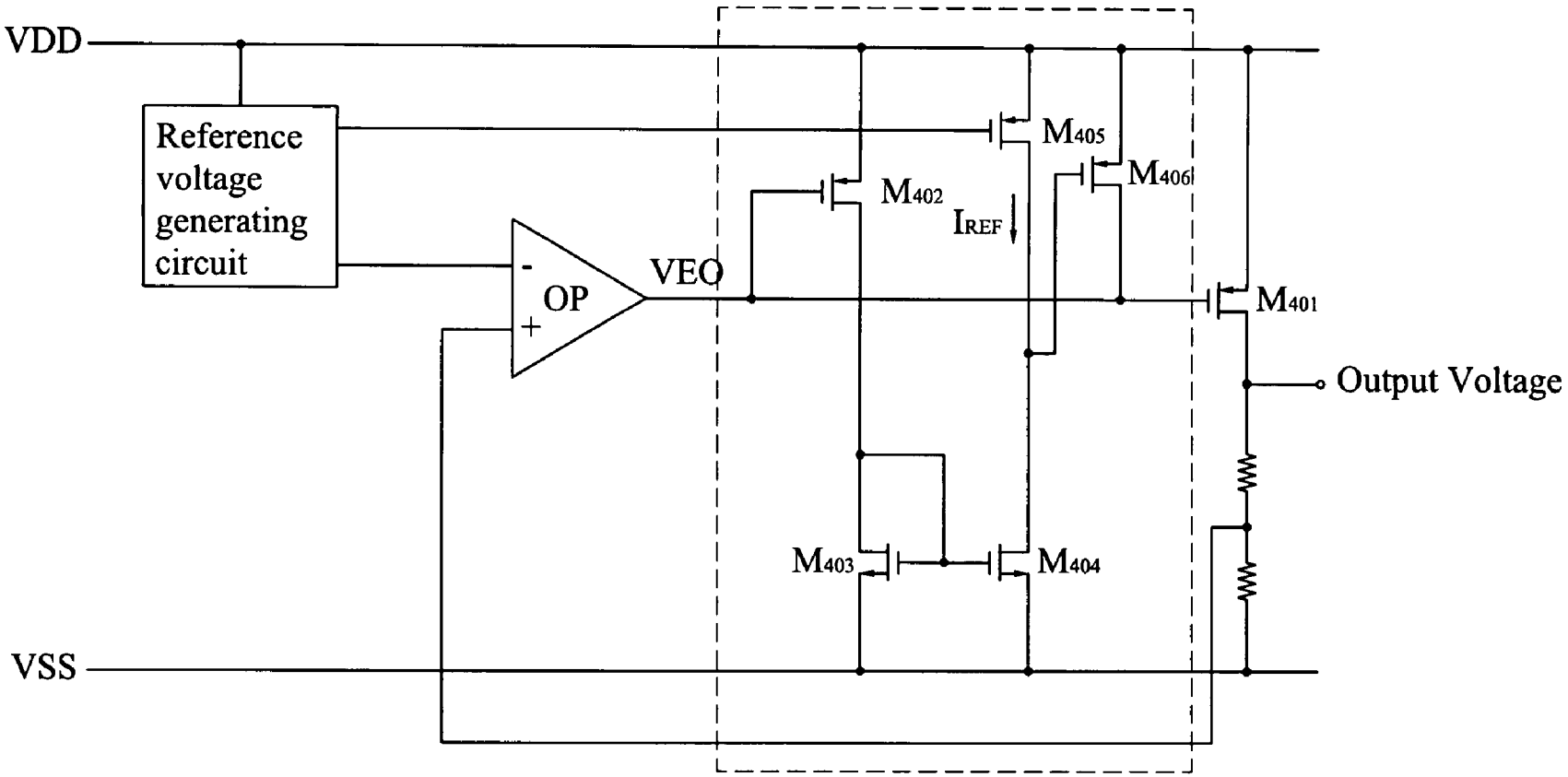
FIG. 4 is a perspective view of a preferred embodiment of the current limiting circuit according to the present invention.

Please refer to FIG. 4, which is a preferred embodiment of the present invention. $M_{401}$ is a power transistor, and transistors $M_{402}$~$M_{406}$ constitute a current limiting circuit, wherein a current $I_{REF}$ flows through $M_{405}$ which is referencing a reference voltage generating circuit. And the transistors actions as follows:

Said $M_{402}$ detects the current flowing through said $M_{401}$. When said $M_{401}$ outputs an excessive current, the current detected by $M_{402}$ will increase correspondingly, and said current detected by $M_{402}$ will be forwarded to a current mirror constructed by said $M_{403}$ and said $M_{404}$, which will be compared with the current $I_{REF}$ flowing through said $M_{405}$ so as to generate a voltage to turn on said $M_{406}$ to generate a charging current to clamp the gate voltage (VEO) of said $M_{401}$, and in this manner the purpose of current limiting is achieved. The current limiting circuit disclosed in the present invention is devoid of any resistors, therefore, the current limiting circuit is also known as active current limiting circuit (ACLC). Since the ACLC is devoid of any resistor, so the die size of the ACLC is relatively smaller.

Said current $I_{REF}$ flows through $M_{405}$ and is referencing said reference voltage generating circuit, therefore, the person skilled in the art can well designate the current $I_{REF}$ to enhance the vulnerability against process and temperature variation and the accuracy of the current limiting in the present invention can be greatly enhanced.

Figure 5:
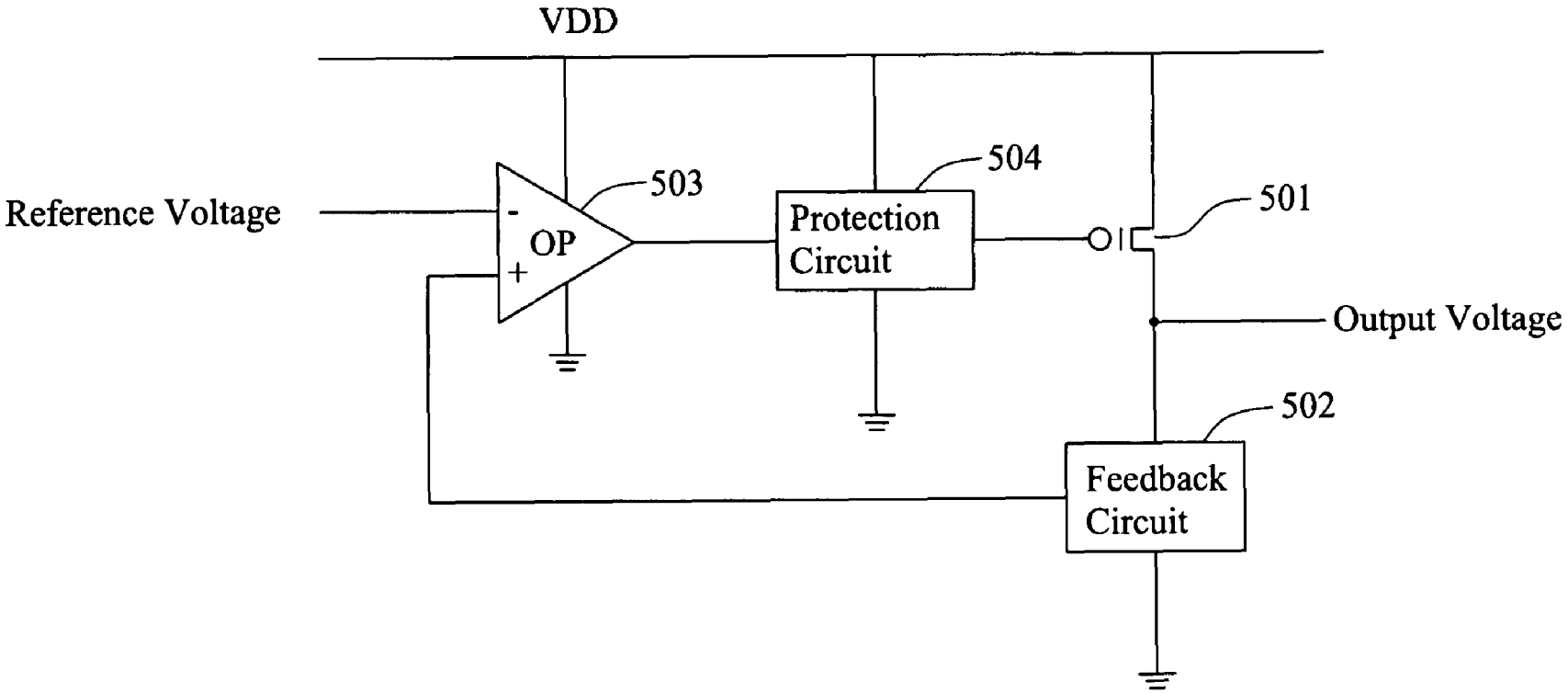
FIG. 5 is a exemplary schematic view of a power regulator according to the present invention.

FIG. 5 relates to a power regulator disclosed in the present invention, said regulator comprises:

a P-typed power transistor 501, said 501's source is receiving an unregulated first voltage source according a control signal and generating a regulated second voltage at its drain;

a feedback circuit 502, generating a feedback signal according to a voltage division with respect to said second voltage;

an operational amplifier 503, said amplifier's output is coupled to the gate of said power transistor 501, said 503's positive input terminal is coupled to said feedback circuit, and said 503's negative terminal is coupled to a reference voltage;

a protecting circuit 504, for being configured to limiting a first current flowing through said P-typed transistor 501, and for enhancing the voltage at the gate of said power transistor 501 when said first current exceeds a predetermined value; wherein, said protecting circuit 504 comprises a plurality of transistors rather than a resistor.

Preferably, said feedback circuit 502 further comprises two serially connected resistors.

Preferably, said protecting circuit 504 further comprises a DC current source such as said $M_{405}$ disclosed in FIG. 4.

Preferably, said circuit 504 further comprises a DC current mirror such as $M_{403}$~$M_{404}$ depicted in FIG. 4.

Preferably, said protecting circuit 504 further comprises:

a DC current mirror, comprising a pair of N-typed transistors such as $M_{403}$~$M_{404}$ depicted in FIG. 4, and said pair of transistors' gates are interconnected, and for one of the pair its gate and its drain are interconnected (See $M_{403}$ in FIG. 4);

a DC current source(See $M_{405}$ in FIG. 4), outputting a predetermined current with a direction to the ground and interconnecting an output terminal of said DC current mirror at a first intersection;

a first P-typed transistor (See $M_{406}$ in FIG. 4), said first P-typed transistor's source is coupled to said first voltage source, and said first P-typed transistor's gate is coupled to said first intersection, and said first P-typed transistor's drain is coupled to said P-typed power transistor's gate; and a second P-typed transistor (See $M_{402}$ in FIG. 4), said second P-typed transistor's source is coupled to said first voltage source, and said second P-typed transistor's gate is coupled to said the gate of said P-typed power transistor, and said second P-typed transistor's drain is coupled to an input terminal of said DC current mirror.

Preferably, said DC current source comprises a P-typed transistor.

Preferably, said DC current mirror is a cascode current mirror.

Preferably, the DC current from said DC current source is generated by a bandgap reference circuit.

The present invention can also be applied to a voltage regulator, which is known by the person skilled in the art, therefore, the repeated information will be omitted.

The invention being thus aforesaid, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A voltage regulator, comprising:

a P-typed power transistor, said transistor's source is receiving an unregulated first voltage source according a control signal and generating a regulated second voltage at its drain;

a feedback circuit, generating a feedback signal according to a voltage division with respect to said second voltage;

an operational amplifier, said amplifier's output is coupled to the gate of said power transistor, said amplifier's positive input terminal is coupled to said feedback circuit, and said amplifier's negative terminal is coupled to a reference voltage; and a protecting circuit, for being configured to limiting a first current flowing through said P-typed power transistor, and for enhancing the voltage at the gate of said power transistor when said first current exceeds a predetermined value comprising:

a DC current mirror, comprising a pair of N-typed transistors, and said pair of transistors' gates are interconnected, and for one of the pair its gate and its drain are interconnected;

a DC current source, outputting a predetermined current with a direction to the ground and interconnect an output terminal of said DC current mirror at a first intersection;

a first P-typed transistor, said first P-typed transistor's source is coupled to said first voltage source, and said first P-typed transistor's gate is coupled to said first intersection, and said first P-typed transistor's drain is coupled to said P-typed power transistor's gate; and a second P-typed transistor, said second P-typed transistor's source is coupled to said first voltage source, and said second P-typed transistor's gate is coupled to said the gate of said P-typed power transistor, and said second P-typed transistor's drain is coupled to an input terminal of said DC current mirror.

2. The voltage regulator as set forth in claim 1, wherein said feedback circuit further comprising two serially connected resistor.

3. The voltage regulator as set forth in claim 1, wherein said protecting circuit further comprising a DC current source.

4. The voltage regulator as set forth in claim 1, wherein said protecting circuit further comprising a DC current mirror.

5. The voltage regulator as set forth in claim 1, wherein said DC current source comprising a P-typed transistor.

6. The voltage regulator as set forth in claim 1, wherein said DC current mirror is a cascode current mirror.

7. The voltage regulator as set forth in claim 1, wherein a DC current of said current mirror is referencing a bandgap reference circuit.

8. A current limit circuit in a power regulator, comprising:

a P-typed power transistor, said transistor's source is coupled to a first voltage source;

a DC current mirror, comprising a pair of N-typed transistors, and said pair of transistors' gates are interconnected, and for one of the pair its gate and its drain are interconnected;

a DC current source, outputting a predetermined current with a direction to the ground and interconnect an output terminal of said DC current mirror at a first intersection;

a first P-typed transistor, said first P-typed transistor's source is coupled to said first voltage source, and said first P-typed transistor's gate is coupled to said first intersection, and said first P-typed transistor's drain is coupled to said P-typed power transistor's gate; and a second P-typed transistor, said second P-typed transistor's source is coupled to said first voltage source, and said second P-typed transistor's gate is coupled to said the gate of said P-typed power transistor, and said second P-typed transistor's drain is coupled to an input terminal of said DC current mirror.

9. The current limit circuit as set forth in claim 8, wherein said DC current source comprising a P-typed transistor.

10. The current limit circuit as set forth in claim 8, wherein said DC current mirror is a cascode current mirror.

11. The current limit circuit as set forth in claim 8, wherein a DC current of the DC current source is referencing a bandgap reference.

12. The current limit circuit as set forth in claim 8, wherein said current limit circuit is of low process variation.

13. The current limit circuit as set forth in claim 8, wherein said current limit circuit is of low temperature variation.

14. A method for limiting a current in a power regulator, comprising the steps of:

providing a constant voltage during periods of normal stable voltage using a power regulator having an internal power transistor providing a loading current;

sensing an output current of said power transistor and determining whether the output current exceeds a threshold or a short circuit is occurring;

when said sensing determines that the output current exceeds a threshold or a short circuit is occurrin activatin an over current limiting circuit until said exceeding current or said short circuit is removed, receiving an unregulated first voltage source according a control signal, and generating a regulated second voltage at the current limiting circuit drain; and when said sensing determines that the output current does not exceed said threshold and no short circuit is occurring, continuing to provide a constant voltage during periods of normal stable voltage using said power regulator.

* * * * *